US008075339B2

(12) United States Patent
Holliday

(10) Patent No.: US 8,075,339 B2
(45) Date of Patent: Dec. 13, 2011

(54) BULGE-TYPE COAXIAL CABLE CONNECTOR WITH PLASTIC SLEEVE

(75) Inventor: Randall A. Holliday, Broomfield, CO (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 12/771,796

(22) Filed: Apr. 30, 2010

(65) Prior Publication Data

US 2010/0273351 A1 Oct. 28, 2010

Related U.S. Application Data

(63) Continuation-in-part of application No. 12/082,584, filed on Apr. 11, 2008, now Pat. No. 7,727,015, which is a continuation-in-part of application No. 11/262,363, filed on Oct. 29, 2005, now Pat. No. 7,410,389, which is a continuation-in-part of application No. 10/927,884, filed on Aug. 27, 2004, now Pat. No. 7,188,507.

(51) Int. Cl.
*H01R 9/05* (2006.01)

(52) U.S. Cl. ..... 439/584

(58) Field of Classification Search ..... 439/583–585, 439/63, 578

See application file for complete search history.

(56) References Cited

U.S. PATENT DOCUMENTS

| | | | |
|---|---|---|---|
| 2,369,180 | A | 2/1945 | Rosenthal |
| 3,126,750 | A | 3/1964 | Willis |
| 3,296,363 | A | 1/1967 | Laudig et al. |
| 4,668,043 | A | 5/1987 | Saba et al. |
| 4,684,201 | A | 8/1987 | Hutter |
| 4,902,246 | A | 2/1990 | Samchisen |
| 4,932,091 | A | 6/1990 | Krzyzanski |
| 5,024,606 | A | 6/1991 | Ming-Hwa |
| 5,073,129 | A | 12/1991 | Szegda |
| 5,105,648 | A | 4/1992 | Steiner et al. |
| 5,127,853 | A | 7/1992 | McMills et al. |
| 5,392,508 | A | 2/1995 | Holliday et al. |
| 5,469,613 | A | 11/1995 | McMills et al. |
| 5,470,257 | A | 11/1995 | Szegda |
| 5,501,616 | A | 3/1996 | Holliday |
| 5,546,653 | A | 8/1996 | Tournier et al. |
| 5,586,910 | A | 12/1996 | Del Negro et al. |
| 5,651,699 | A | 7/1997 | Holliday |
| 5,667,405 | A | 9/1997 | Holliday |
| 5,845,393 | A | 12/1998 | DePaiva |
| 5,863,220 | A | 1/1999 | Holliday |
| 5,934,137 | A | 8/1999 | Tarpill |
| 5,975,949 | A | 11/1999 | Holliday et al. |
| 5,997,350 | A | 12/1999 | Burris et al. |
| 6,089,913 | A | 7/2000 | Holliday |
| 6,112,404 | A | 9/2000 | Tarpill |
| 6,146,197 | A | 11/2000 | Holliday et al. |
| 6,153,830 | A | 11/2000 | Montena |
| 6,293,004 | B1 | 9/2001 | Holliday |

(Continued)

*Primary Examiner* — Jean Duverne
(74) *Attorney, Agent, or Firm* — Foley & Lardner LLP

(57) ABSTRACT

A cable termination assembly is made up of one of a plurality of connector bodies each having a thin-walled outer sleeve which may be composed of metal or plastic, the outer sleeve having a raised external wall surface portion which may be of convex or truncated convex configuration with or without depressions or interruptions in its external surface; and, depending on the pull out force required, utilization of a plastic sleeve enabling the use of a crimping ring consisting entirely of a metal ring of substantially uniform diameter with notch portions to engage external protuberances on the outer sleeve of the connector body.

20 Claims, 12 Drawing Sheets

U.S. PATENT DOCUMENTS

| | | | | |
|---|---|---|---|---|
| 6,352,448 | B1 | 3/2002 | Holliday et al. | |
| 6,594,888 | B2 | 7/2003 | Chang | |
| 6,783,394 | B1 | 8/2004 | Holliday | |
| 6,830,479 | B2 * | 12/2004 | Holliday | 439/585 |
| 6,848,940 | B2 | 2/2005 | Montena | |
| 6,916,200 | B2 | 7/2005 | Burris et al. | |
| 6,935,892 | B2 | 8/2005 | Holliday | |
| 7,156,695 | B2 * | 1/2007 | Holliday | 439/584 |
| 7,179,122 | B2 * | 2/2007 | Holliday | 439/585 |
| 7,188,507 | B2 | 3/2007 | Holliday et al. | |
| 7,326,079 | B2 * | 2/2008 | Holliday et al. | 439/578 |
| 7,410,389 | B2 * | 8/2008 | Holliday | 439/578 |
| 7,727,015 | B2 * | 6/2010 | Holliday | 439/584 |
| 2005/0148236 | A1 | 7/2005 | Montena | |

* cited by examiner

BULGE-TYPE COAXIAL CABLE CONNECTOR WITH PLASTIC SLEEVE

CROSS-REFERENCE TO RELATED APPLICATIONS

This application is a continuation-in-part of U.S. patent application Ser. No. 12/082,584, filed 11 Apr. 2008, for BULGE-TYPE COAXIAL CABLE CONNECTOR which is a continuation-in-part of U.S. patent application Ser. No. 11/262,363, filed 29 Oct. 2005, for BULGE-TYPE COAXIAL CABLE TERMINATION ASSEMBLY, by Randall A. Holliday, and incorporated herein by reference, which, in turn, is a continuation-in-part of U.S. patent application Ser. No. 10/927,884, filed 27 Aug. 2004, now U.S. Pat. No. 7,188,507, issued 13 Mar. 2007, for COAXIAL CABLE FITTING AND CRIMPING TOOL by Randall A. Holliday and Robert M. Parker, and incorporated herein by reference.

BACKGROUND AND FIELD

The following relates to cable termination assemblies; and more particularly relates to a novel and improved termination assembly for efficiently connecting a coaxial cable to a selected device, such as, the terminal on a home entertainment system or television set.

Coaxial cables are broadly comprised of inner and outer concentric conductors separated by a dielectric insulator and encased or covered by an outer jacket of a rubber-like material. Numerous end connectors have been devised to effect a secure mechanical and electrical connection to the end of the coaxial cable typically by having the inner conductor and dielectric insulator extend through an inner sleeve of the termination assembly while the outer conductor and jacket are inserted into an annular space between the inner sleeve and outer sleeve. The outer sleeve is then crimped in a radially inward direction to securely clamp the end of the cable within the connector, and a fastener on the opposite end of the connector is then connected to the post or terminal, such as, for example, by a nut on the opposite end of the termination assembly to the inner and outer sleeves, or by a bayonet pin and slot between the connecting members, or by means of a suitable press fit or snap fit connection. Representative termination assemblies or connectors that have been devised for this purpose are disclosed in U.S. Pat. Nos. 5,501,616, 6,089,913 and 5,863,220, all invented by the applicant of this patent application.

As a setting for the present invention, the '616 patent referred to above utilizes serrations along the inner sleeve of the connector and sealing ribs along an inner surface of the outer sleeve and in facing relation to the serrations so as to effect a secure weather-tight seal with the outer conductor and jacket which are inserted between the inner and outer sleeves.

There is a continuing need for a compression-type coaxial cable and connector which can achieve improved mechanical connection between the cable and connector in response to axial advancement of one or more crimping rings along the end of the cable-receiving connector and which is conformable for use in connecting different sizes and types of coaxial cables to the connector with a single crimping ring or two-stage crimping ring.

SUMMARY

It is therefore desirable to provide for a novel and improved compression connector for cables and specifically for coaxial cables. For example, to provide for a novel and improved compression connector capable of effecting improved localized sealed engagement with a cable end in response to axial advancement of a crimping ring while avoiding the necessity of separate seals between the connecting parts; and another example is to provide for a novel and improved coaxial cable compression connector which is conformable for use with different types and sizes of coaxial cables and requires a minimum of force in radially contracting an end of the connector into localized sealed engagement with the cable. In this relation, it is desirable to enable compression of the connector sleeve onto the cable at different locations along the sleeve and in such a way as to minimize the amount of force required to compress the sleeve or in some cases to lengthen the length or area of gripping engagement between the connector sleeve and cable.

In one embodiment, there has been devised a connector for connecting a cable having an electrically conductive member to another electrically conductive member comprising a sleeve member of a generally cylindrical configuration sized for insertion of an end of the cable, the sleeve having an external rounded or raised, flat wall surface portion having one or more depressions or axially spaced slots and axially spaced at different selected locations away from the entrance end of the connector sleeve and normally protruding from the external wall surface of the connector sleeve. The sleeve itself has an inner uniform diameter to afford ample clearance for ease of insertion of varying sizes of cable; and a compression member is dimensioned to advance over the connector sleeve to engage the rounded or raised surface portion. Axial advancement of the compression member along the connector sleeve will impart inward radial deformation to the rounded or raised surface portion on the connector sleeve into sealed engagement with the cable. Single or multiple compression rings may be employed to successively impart inward radial deformation to the rounded or raised wall surface.

In another embodiment, a modified form of connector body includes an outer concentric, compressible plastic sleeve member which is sized for axial insertion of an end of the cable, the plastic sleeve member being provided with a raised surface portion which will undergo inward radial deformation in response to advancement of a crimping ring over the outer sleeve member. The plastic sleeve is characterized by being less expensive to construct and does not require as much compressional force to be exerted by the crimping ring so that a simplified form of crimping ring may be utilized in completing the assembly.

Especially when used in terminating coaxial cable ends, the connector is provided with inner and outer concentric sleeve members with axially spaced sealing ribs on an inner surface of the outer sleeve so that when the outer layers of the cable are inserted into the space between the inner and outer sleeve members and a crimping force applied to the outer sleeve will effect sealed engagement between the inner sealing ribs and outer layers of the cable in creating the most effective localized sealed engagement along the area of the sealing ribs.

The above and other objects, advantages and features will become more readily appreciated and understood from a consideration of the following detailed description of preferred and modified forms of the present invention when taken together with the accompanying drawings in which:

DETAILED DESCRIPTION

Figure 1:
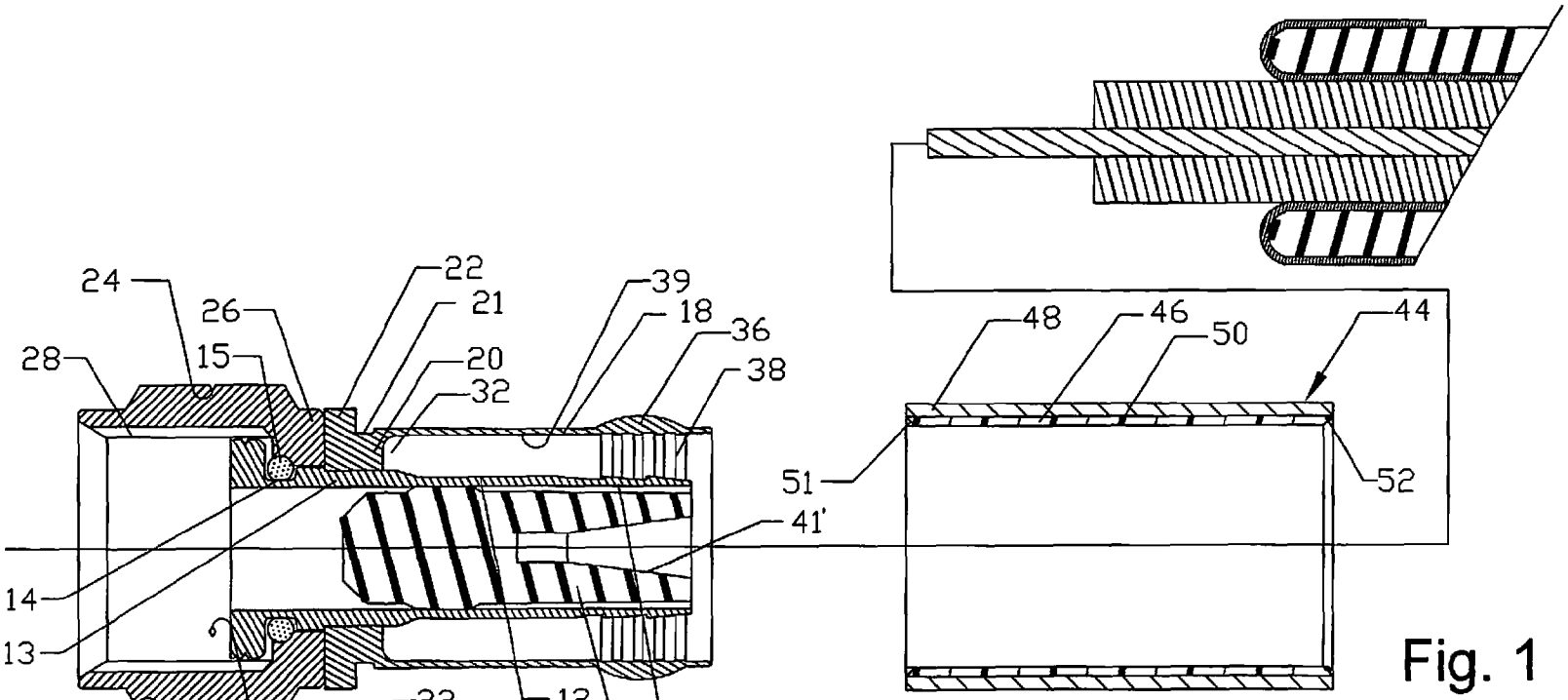
FIG. 1 is a longitudinal section view of one form of connector and illustrating the compression member and cable in the open position prior to assembly.
Figure 2:
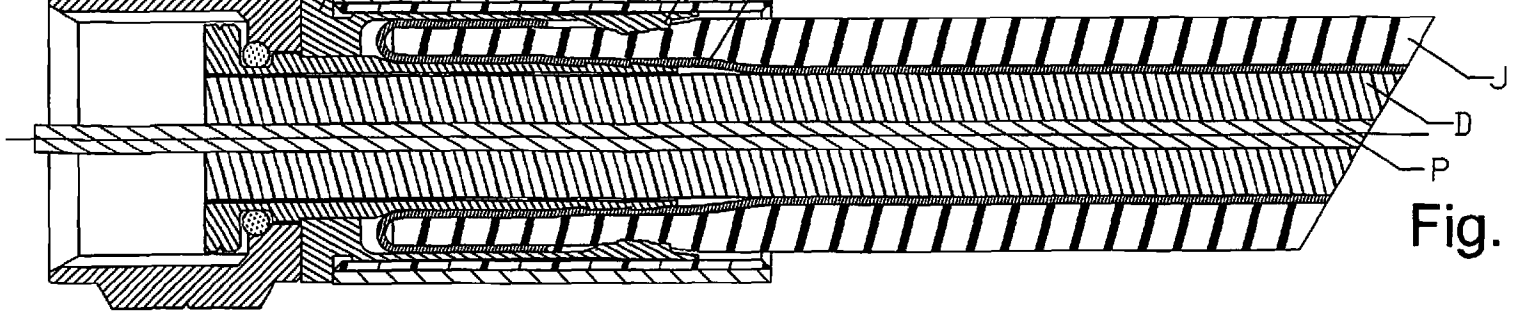
FIG. 2 is a longitudinal section view of the form shown in FIG. 1 illustrated in the closed position.

Referring in more detail to the drawings, one form of fitting is illustrated in FIGS. 1 and 2 wherein the fitting is made up of a connector 10 for connecting a first electrically conductive member, such as, a standard coaxial cable C to a second electrically conductive member, such as, a television terminal or terminal on different components of a home entertainment system, not shown. The end connector 10 is broadly comprised of an elongated thin-walled inner sleeve 12 at an entrance end, the sleeve 12 increasing in thickness along a midportion 13 into an external groove and terminating in an external shoulder or ferrule 16; and an outer thin-walled sleeve 18 extends from a point slightly beyond the inner wall 12 at the entrance end, is of uniform thickness along its greater length and is provided with an external groove 21 which is flanked at one end by external shoulder 22.

The inner and outer sleeves 12 and 18 extend rearwardly from the entrance end in spaced concentric relation to one another so as to form an annular space 32 therebetween for insertion of a standard cable C in a manner to be described. The inner sleeve 12 is of substantially uniform wall thickness for its greater length and has a plurality of axially spaced, annular serrations 34 along its outer wall surface and toward the entrance end. The outer sleeve 18 is thin-walled along its greater length but gradually increases in thickness to define an external convex surface portion 36 and which has a plurality of axially spaced circumferential slots or grooves 37. A series of sealing rings 38 defined by a plurality of axially spaced alternate ribs and grooves in accordance with U.S. Pat. No. 5,501,616. The rings 38 project inwardly from inner wall surface 39 along a limited length of the sleeve 18 in opposed or confronting relation to the serrations 34.

A crimping ring 44 is of generally cylindrical configuration and of a length corresponding to the length of the thin-walled sections of the outer sleeve 18. Preferably, the member 44 is comprised of an inner liner 46 of uniform thickness and diameter throughout which terminates in beveled end 51 and 52, and an outside band 48 similarly is of uniform thickness and diameter throughout and is coextensive with the liner 46. The inner liner 46 is composed of a material having a slight amount of give or resilience, such as, a high strength plastic material sold under the trademark "DELRIN®"; and the outer band 48 is composed of a material having little or no give or compressibility, such as, a brass material. The liner 46 and the band 48 are of substantially corresponding thickness, and the liner 46 is mounted in pressfit relation inside of the band 48 with its inner wall surface 50 being of a diameter corresponding to or slightly greater than the outer diameter of the sleeve 18 at its entrance end. The liner 46 has an inner diameter less than the convex surface portion 36 on the outer sleeve so that when the ring 44 is axially advanced over the sleeve will impart inward radial deformation to the convex surface portion causing it to be contracted, as illustrated in FIG. 2, into engagement with the cable C.

Figure 11:
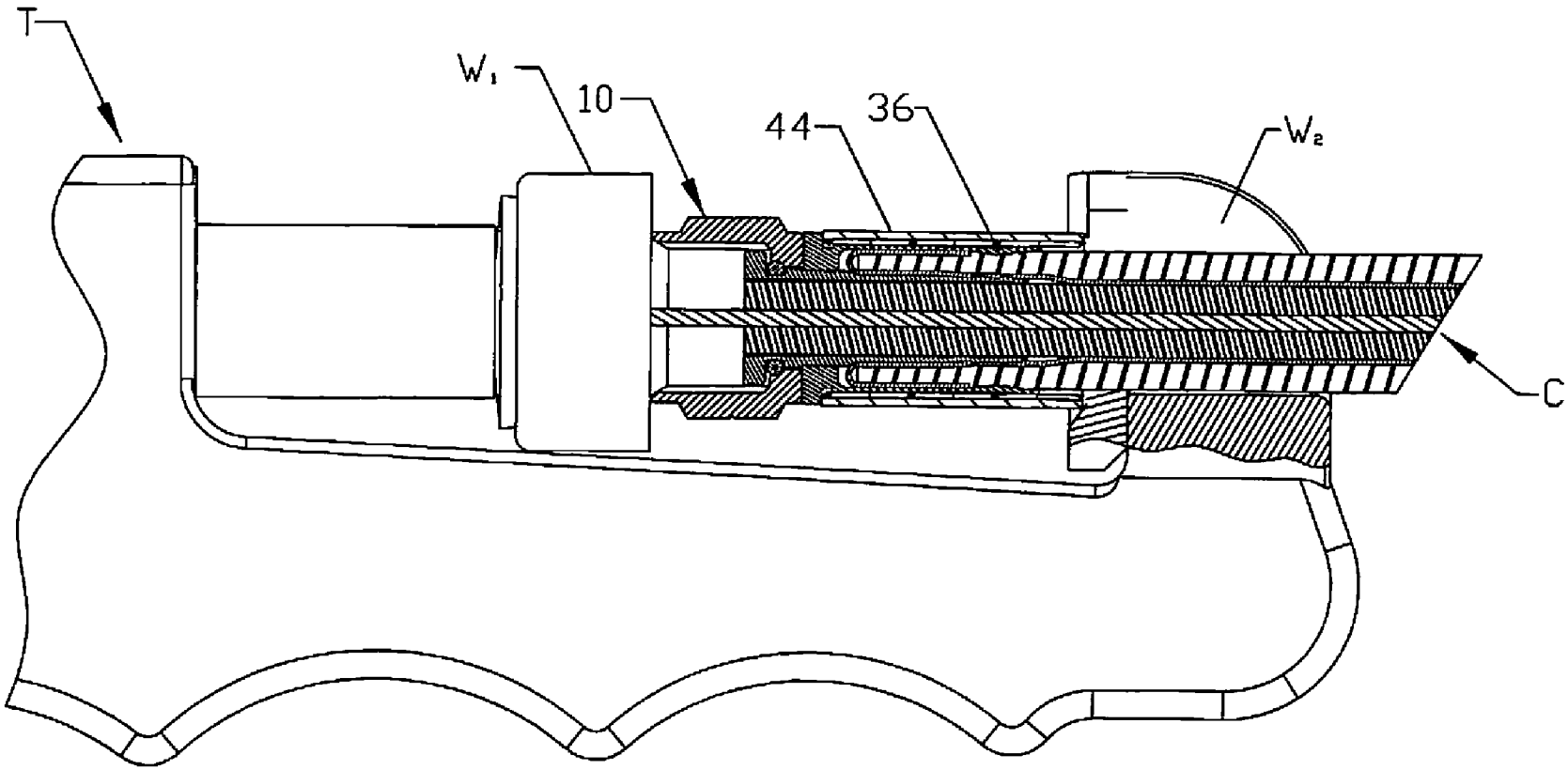
FIG. 11 is a somewhat schematic view of a standard compression tool employed in carrying out the crimping operation on any one of the embodiments illustrated herein.

The cable C is connected to the connector 10 by first preparing the leading end of the cable to fold the braided layer B over the end of the jacket J, as illustrated in FIG. 1. The compression ring 44 is aligned, as illustrated in FIG. 1, with the end of the connector 10, following which the leading end of the cable C is advanced through the compression ring 44 into the annular space 32 between the inner sleeve 12 and outer sleeve 18. In order to facilitate accurate alignment of the end of the cable C with the annular space 32, a starter guide 41, as illustrated in FIG. 1 may be positioned within the central opening of the inner sleeve 12, the starter guide being a snub-nosed member with a tapered opening or socket 41' at one end to guide the exposed end of the pin conductor P into centered relation to the connector body thereby aligning the jacket J and doubled-over end of the braided layer B with the annular space 32. A standard compression tool T, such as, that illustrated in FIG. 11, is provided with jaws W1 and W2 which are spread far enough apart to permit insertion of the assembled connector 10 and compression member 44 between the jaws. A lever arm on the tool, not shown, will impart sufficient axial force in squeezing the jaws W1 and W2 together to advance the compression member 44 over the bulge or convex surface portion 36 whereby to radially deform or contract that portion of the sleeve 18 inwardly so that the portion 36 will be bowed in a radially inward direction, as shown in FIG. 2, and cause the jacket J as well as at least a portion of the braided layer B to be compressed slightly between the inner and outer sleeves 12 and 18. Once the installation is completed, the starter guide 39 may be removed from the end of the pin conductor P and discarded. The compression tool T is shown and described in detail in U.S. Pat. No. 6,708,396 which is incorporated by reference herein.

Figure 3:
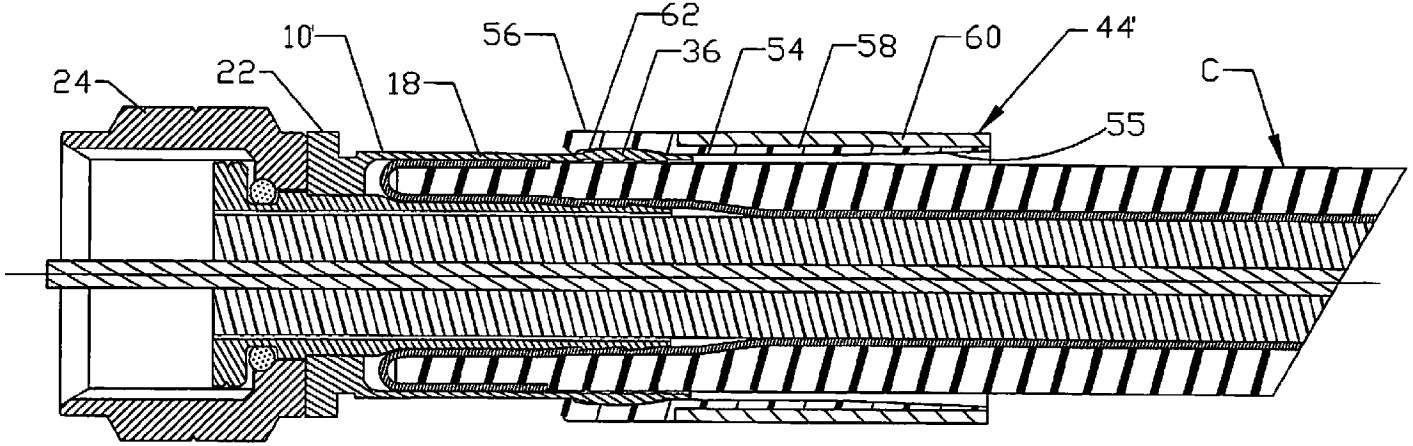
FIG. 3 is a longitudinal section view of another example illustrating the compression member in the open position and pre-assembled onto the end of a connector body.
Figure 4:
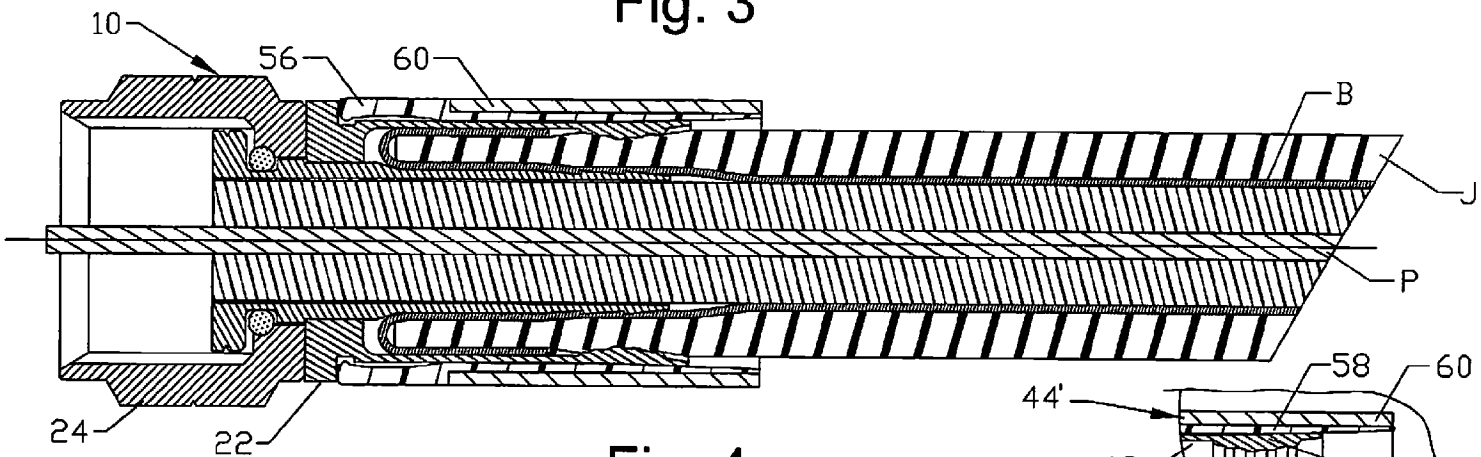
FIG. 4 is a longitudinal section view of the form illustrated in FIG. 3 with the termination assembly shown in the closed position.
Figure 4A:
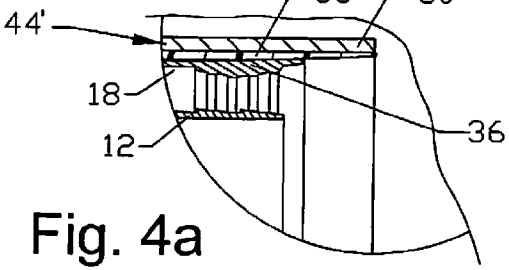
FIG. 4A is an enlarged, fragmentary detailed view of a portion of the entrance end of the connector body shown in FIG. 4.

Another form of termination assembly is illustrated in FIGS. 3, 4 and 4A which illustrates a connector 10 corresponding to the connector 10 of FIGS. 1 and 2 and like parts are correspondingly enumerated. A compression ring 44' is modified somewhat from the compression ring 44 of FIGS. 1 and 2 by the utilization of an inner liner 54 of increased thickness at one end 56 and includes an inset portion 58 over its greater length to receive an outer band 60. The thickened end portion 56 is provided with an inner concave surface portion 62 which is complementary to the convex surface portion 36 on the outer connector sleeve 18 in order to facilitate mounting of the compression ring member 44' onto the end of the connector 10', as illustrated in FIG. 3. Again, the liner 54 is composed of a material having some give or resiliency as in the form of FIGS. 1 and 2 and therefore can be manually advanced into the pre-installed mounting position shown in FIG. 3. The inner liner 54 has an inner surface 55 substantially corresponding in diameter to the external diameter of the connector 18 at its entrance end and will expand slightly as it is passed over the convex surface portion 36, then return to its original diameter after the concave surface portion 62 moves into alignment and flush engagement with the convex surface portion 36. However, under continued axial advancement toward the closed position shown in FIG. 3, the outer band 60 will resist any tendency of the liner 54 to expand as it advances over the convex portion 36 and will impart sufficient force to cause inward radial deformation of the convex surface portion 36 into the reverse convex curvature as shown in FIG. 4.

FIG. 4A illustrates in greater detail the inward radial deformation of the convex surface portion 36 into compressed relation to the outer jacket J of the cable C and, depending upon the length of the doubled-over portion of the braided conductor 106, will compress the braided conductor as well.

Figures 5, 6, 7:
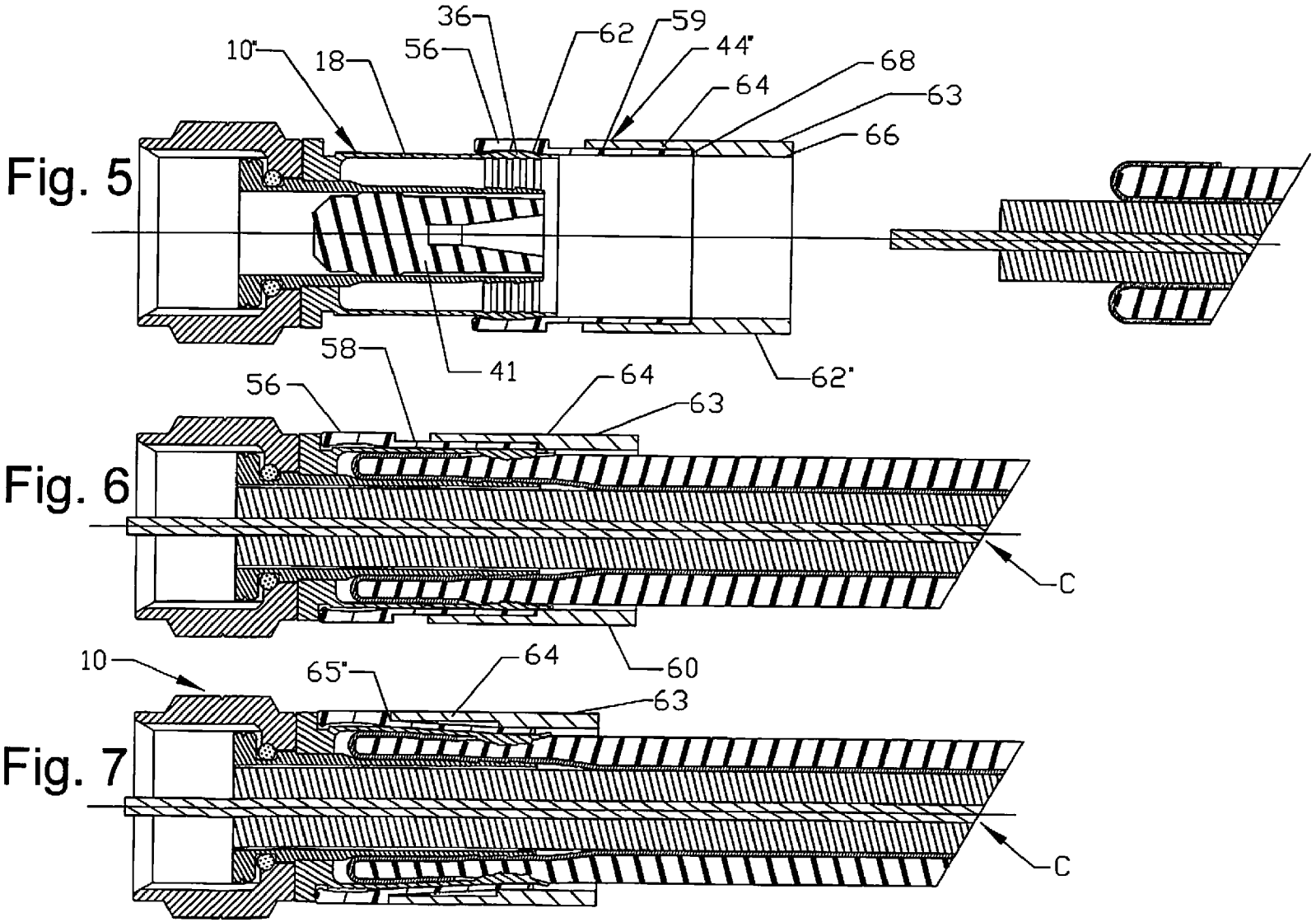
FIG. 5 is a longitudinal section view of another embodiment shown in the pre-assembled position with a multi-stage compression member.
FIG. 6 is a longitudinal section view of the embodiment shown in FIG. 5 with the compression member shown in a partially closed position.
FIG. 7 is another longitudinal section view of the embodiment shown in FIGS. 5 and 6 with the compression member in the fully closed position.

Another embodiment is illustrated in FIGS. 5 to 7 wherein a connector 10 corresponding to the connector 10 of FIGS. 1 and 2 is utilized with another modified form of compression ring 44". The ring 44" is made up of an inner liner 58 corresponding to the liner 58 of FIGS. 3 and 4 including a thickened portion 56 and an inset portion 59 to receive an outer band 63 which is slidably mounted on the inset portion 59 so as to define a multi-stage compression ring 44". The outer band 63 includes a leading end 64 having an inner diameter corresponding to the outer diameter of the inset portion 59 of the liner 58 and a trailing end portion 66 which is thickened with respect to the leading end 64 and stepped inwardly to be of a reduced inside diameter corresponding to the inner diameter of the liner 58. A shoulder 68 between the leading end 64 and trailing end 66 is beveled somewhat and acts as an initial stop when the band 63 is partially assembled onto the liner 58 as illustrated in FIG. 5.

The leading end 56 is pre-assembled onto the connector 10 by advancing the concave surface portion 62 over the convex surface portion 36 as illustrated in FIG. 5. Continued axial advancement of the liner 58 will cause the leading end portion 56 to advance forwardly toward the closed position as the leading end portion 64 of the band 63 advances over the convex surface portion 36. The increased pressure imparted by the leading end 64 of the band 63 will compress the convex surface portion 36 into engagement with the cable C. Termination is completed by continued advancement of the band 63 over the liner 58 until the band moves into engagement with the external shoulder 65 on the liner. In this way, the inward radial deformation of the convex surface portion 36 and adjacent portions of the outer sleeve 18 is more gradual than that of FIGS. 3 and 4 but results in increased pressure by virtue of the direct application of force by the trailing end 66 of the band moving into engagement with the entrance end of the connector sleeve 18.

Figure 8:
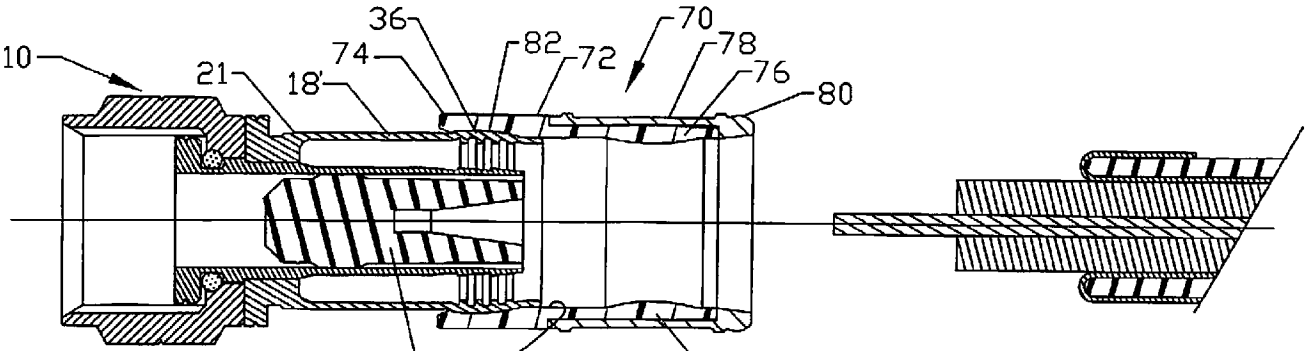
FIG. 8 is a longitudinal section view of still another embodiment with the compression member shown in a pre-assembled or partially closed position.
Figure 9:
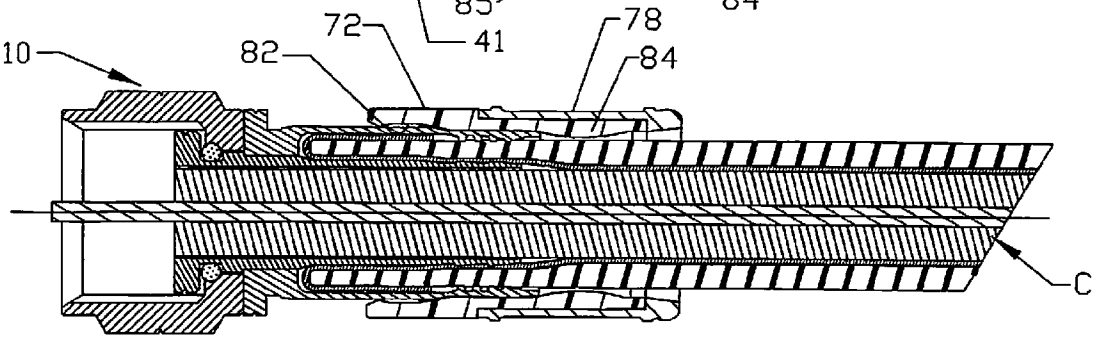
FIG. 9 is a longitudinal section view of the form shown in FIG. 8 after compression of the connector has been initiated.
Figure 10:
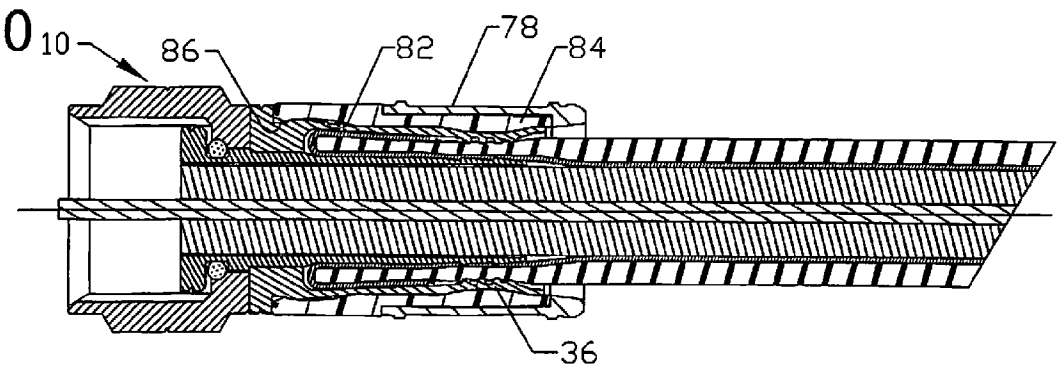
FIG. 10 is a longitudinal section view of the form shown in FIGS. 8 and 9 after completion of the crimping operation and with the compression member advanced to the closed position.

In the form illustrated in FIGS. 8 to 10, a connector 10 corresponding to the connector 10 of the previous embodiments described has like parts correspondingly enumerated to the previous embodiments. One departure from the previous embodiments described is noted with prime numerals and has reference to the slight reduction in diameter of outer connector sleeve 18' toward the entrance end except of course for convex surface portion 36. In addition, a compression member in the form of a crimping ring 70 is comprised of an inner liner 72 made up of a thickened portion 74 and inset portion 76 to receive a band 78 which is mounted in fixed relation to the liner 72 and has a relatively thick trailing end portion 80.

The crimping ring 70 is characterized in particular by having a first concave surface portion 82 along the inner wall surface of the thickened portion 72 which is not covered by the band 78, a second, axially spaced convex surface portion 84 toward its trailing end which is surrounded by the outer band 78, and a uniform diameter surface portion 85. In this way, the leading end 72 may be pre-assembled onto the connector 10, as illustrated in FIG. 9, by advancing the concave surface portion 82 over the convex surface portion 36 into the partially closed position shown in FIG. 9. Continued axial advancement of the liner 82 causes the inner convex surface portion 84 to traverse the convex surface portion 36 on the connector sleeve 18' to cause the convex surface portion 36 to undergo inward radial contraction into positive engagement with the jacket on the cable C, as illustrated in FIG. 10. The leading end of the liner 74 includes a slight protuberance 86 which will advance into the external groove 21 on the connector body as shown in FIG. 10.

Figure 12:
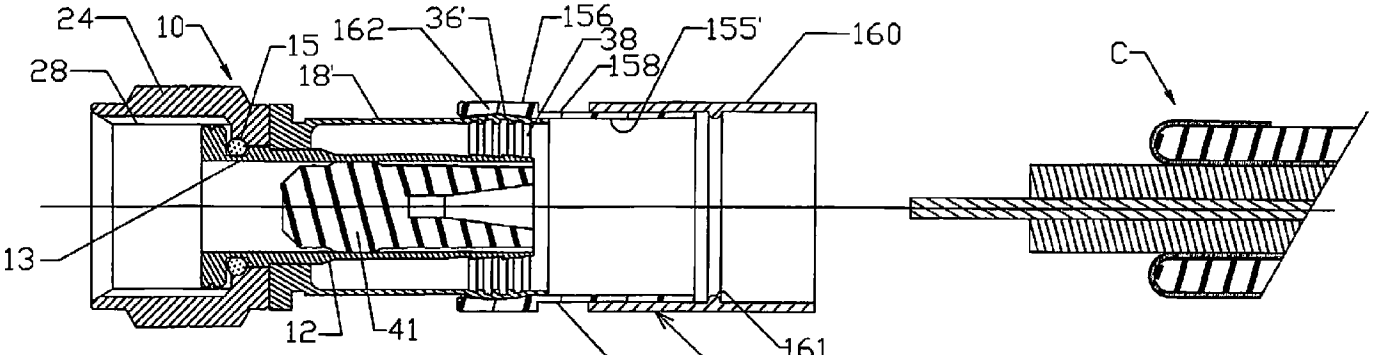
FIG. 12 is a longitudinal section view of another embodiment of a connector body with the compression member shown in a pre-assembled position on the connector body.
Figure 13:
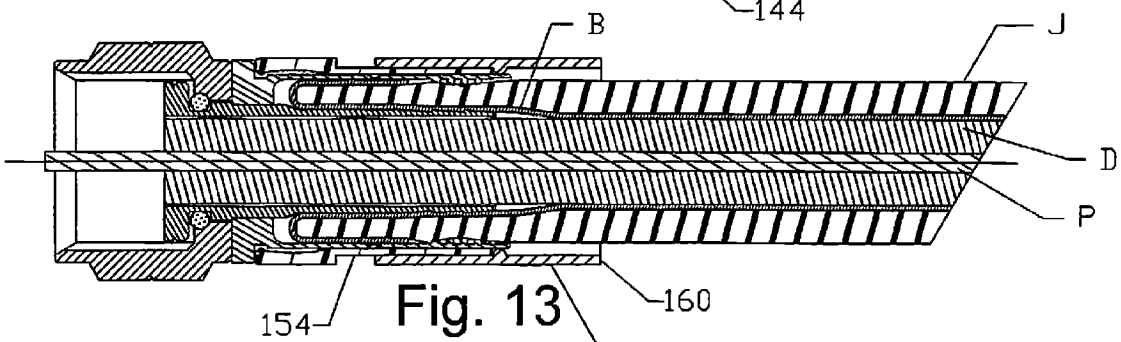
FIG. 13 is a longitudinal section view of the form shown in FIG. 12 in a partially closed position.
Figure 14:
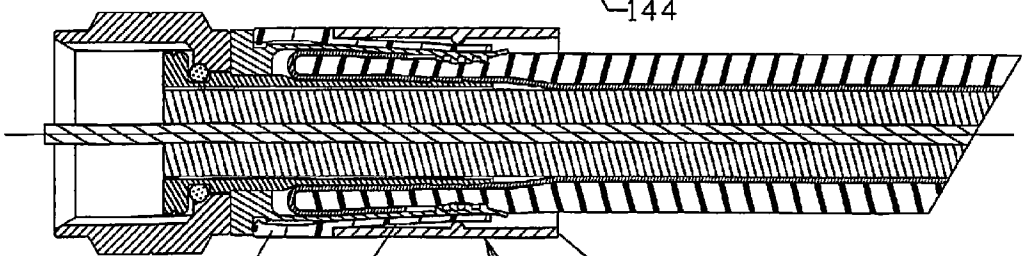
FIG. 14 is a longitudinal section view of the form shown in FIG. 12 in a fully closed position.

FIGS. 12 to 14 illustrate an F-type connector body which corresponds to the connector bodies 10 of FIGS. 1-7, and wherein like parts are correspondingly enumerated both with respect to the connector body 10 and the cable C. However, the compression member as defined by a crimping ring 144 is made up of an inner liner 154 of increased thickness at one end 156 and includes an inset portion 158 over its greater length to receive an outer metal band 160. The end portion 156 includes an inner concave surface portion 162 complementary to the convex surface portion 36 on the outer connector sleeve 18 in order to pre-assemble the crimping ring 144 onto the end of the connector body, and the inner surface 155 of the liner 154 is of substantially the same diameter as the external diameter of the outer sleeve member 18 at its entrance end and will expand slightly as it is passed over the convex surface portion 36 then return to its original diameter. The outer band 160 includes an inner surface of uniform diameter throughout with the exception of an internal annular rib 161 at the midsection of the inner surface. When the compression ring is pre-assembled onto the connector sleeve 18 as illustrated in FIG. 12, the rib 161 will initially act as a stop to limit the forward slidable advancement of the band 160 over the inner liner 154. Continued axial advancement of the crimping ring 144 over the connector sleeve 18, for example, under the urging of a compression tool as illustrated in FIG. 11, will cause the rib 161 on the outer band 160 to slide over the inner liner 154 as the leading end 156 is advanced toward the shoulder 22, as shown in FIG. 13. The outer metal band 160 will cooperate with the inner liner 154 in forcing inward radial deformation of the sealing ribs 38 on the inner surface of the sleeve 18 into positive sealed engagement with the cable so that there is a progressive inward radial deformation of the sealing ribs in response to advancement of the concave surface portion 162 at the leading end of the liner followed by increased deformation of the sealing ribs 38 in response to advancement of the internal rib 161 on the band 160 over the convex surface portion.

Figure 15:
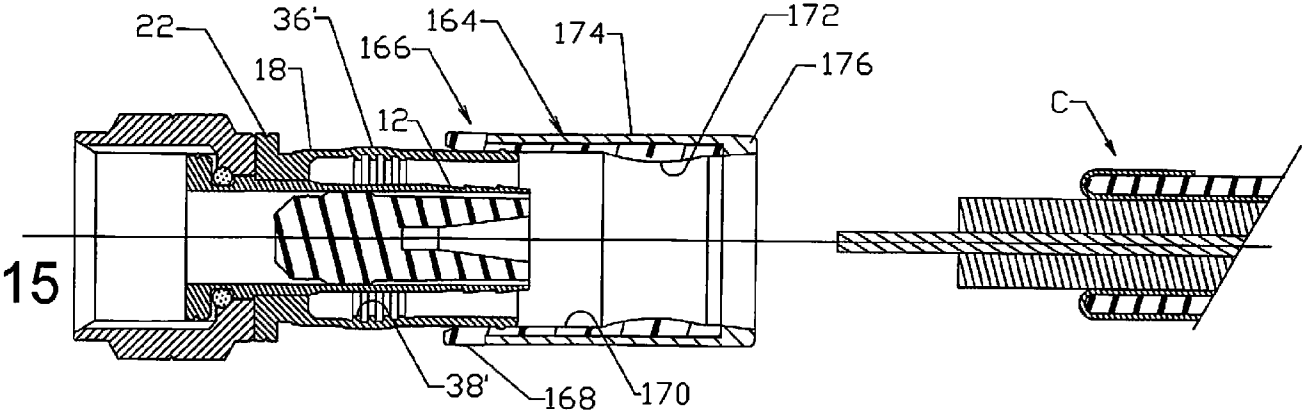
FIG. 15 is a longitudinal section view of a modified form of connector body and compression member shown in the pre-assembled position on the connector body.
Figure 16:
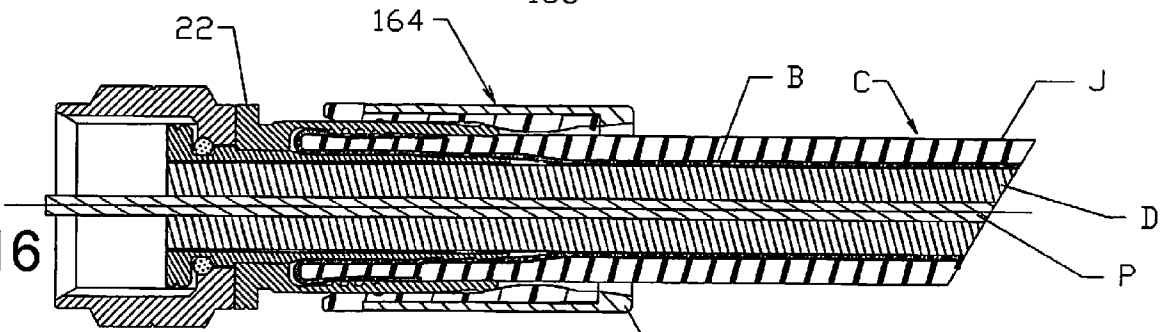
FIG. 16 is a longitudinal section view of the embodiment shown in FIG. 15 in a partially closed position.
Figure 17:
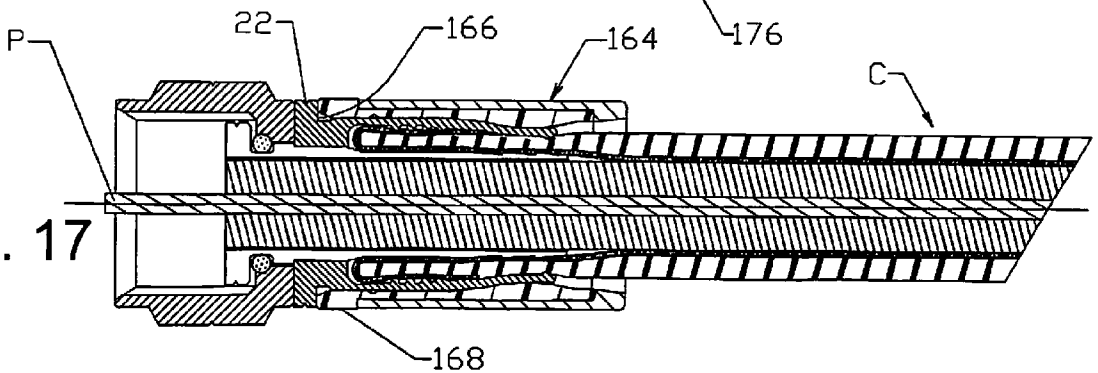
FIG. 17 is a longitudinal section view of the form shown in FIG. 16 in a fully closed position.

In the embodiment of FIGS. 15 to 17, like parts to those of the previous embodiments described are correspondingly enumerated and modified parts are designated by prime numerals. The connector body 10' of FIGS. 15 to 17 includes the same elements as the connector bodies previously described but is modified by movement of the external convex surface portion 36' away from the entrance end and to an intermediate portion relatively close to the fastener end of the inner and outer sleeves 12 and 18 which is opposite to the entrance end. The inner sleeve 12 is of substantially uniform thickness and includes a plurality of axially spaced, annular serrations 34 as previously described with respect to the forms of FIGS. 1 to 10, and axially spaced sealing rings 38' project inwardly from inner wall surface 39' of the outer sleeve 18 along a limited length of the sleeve 18 so as to be oriented beneath the convex surface portion 36'.

A modified form of crimping ring 164 is made up of an inner liner 166 having a thickened leading end portion 168 and inset portion 170 provided with an inner convex surface portion 172 toward its trailing end. An outer metal band 174 is seated in the inset portion 170 so that its external surface is flush with the external surface of the thickened end 168, and its trailing end 176 extends slightly beyond the trailing end of the inner liner 170 with the trailing end inner surfaces diverging outwardly. The inner surface of the liner 166 is of a diameter corresponding to that of the external surface of the outer sleeve 18 so that it can be pre-assembled into tight-fitting engagement on the end of the sleeve 18 as illustrated in FIG. 15. When the crimping ring 164 is axially advanced to the partially closed position shown in FIG. 16, the leading end 168 will deform the convex surface portion 36' radially inwardly as the inner convex surface portion 172 on the crimping ring 164 approaches the entrance end of the outer sleeve 18. Cable C is installed with a started guide 41 as described on page 8 into centered relation to the connector body so as to align the jacket J and double-over end of the braided layer B with the annular space 32 between the inner and outer sleeves 12 and 18, respectively. Also, a standard compression tool T of the type illustrated in FIG. 11 can be utilized to impart sufficient axial force to advance the crimping ring 144 over the convex surface portion 36' to radially deform the sleeve 18 inwardly and cause the sealing rings 38 to be inwardly deformed into positive engagement with the braided layer B as well as the jacket J and compress the remaining length of the sleeve 18 into engagement with the jacket J.

Under continued axial advancement into the fully closed position shown in FIG. 17 the inner convex surface portion 172 will impart radially inward deformation to the entrance end and slightly beyond the entrance end until the leading end 168 abuts the external shoulder 22. As a result, the outer sleeve 18 is deformed along its substantial length into positive gripping engagement with the jacket J on the cable.

Figure 18:
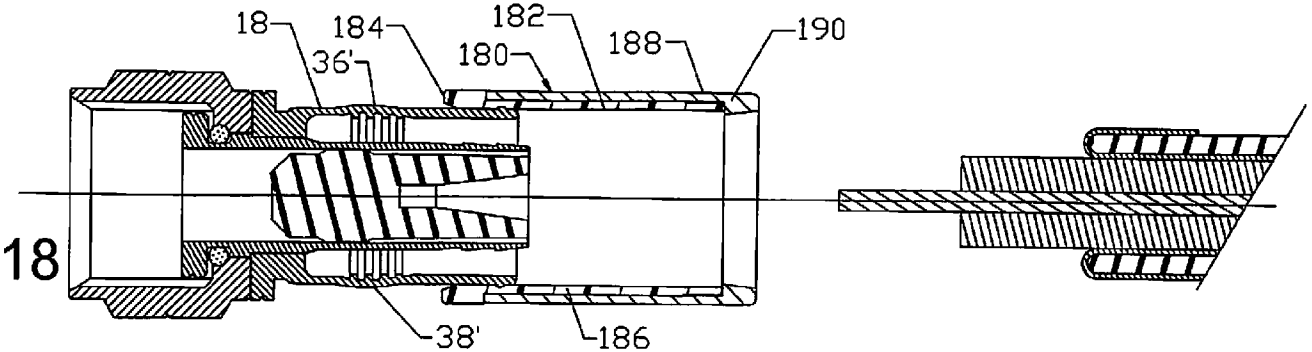
FIG. 18 is a longitudinal section view of still another embodiment with a compression member shown in a pre-assembled position with respect to a connector body.
Figure 19:
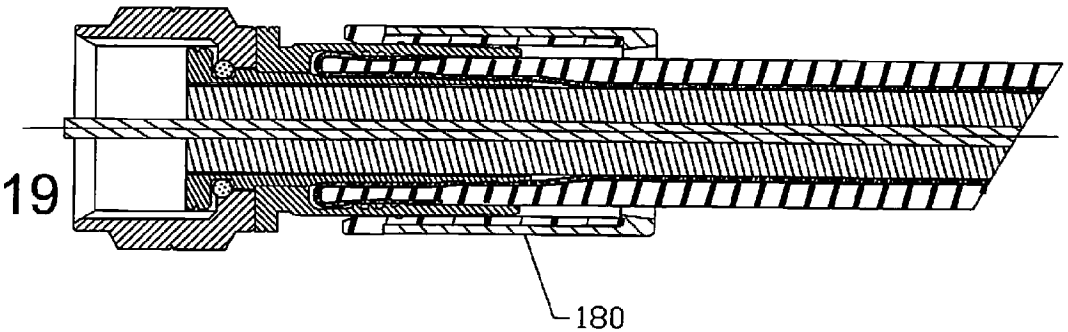
FIG. 19 is a longitudinal section view of the embodiment shown in FIG. 18 in a partially closed position.
Figure 20:
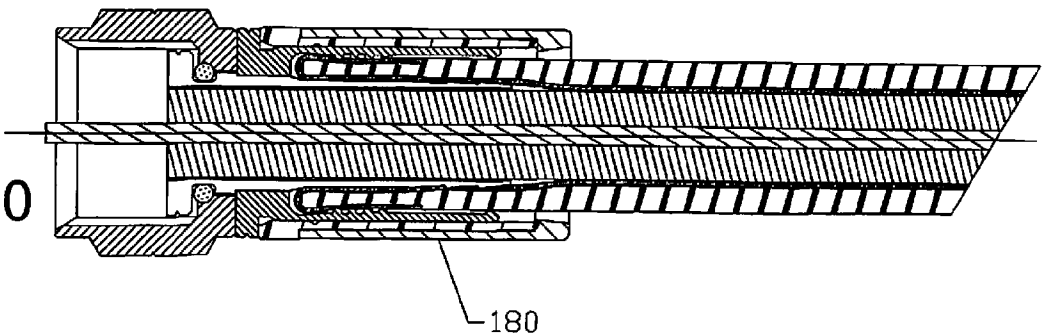
FIG. 20 is a longitudinal section view of the embodiment shown in FIGS. 18 and 19 in a fully closed position.

FIGS. 18 to 20 illustrate the same connector body as FIGS. 15 to 17 including the intermediately located convex surface portion 36' and inner sealing rings 38' in combination with a modified form of crimping ring 180 in which the inner liner 182 includes a beveled leading end 184 and an inset portion 186 extending the greater length of the liner to receive an outer metal band 188 in press-fit engagement with the external surface of the liner 182 and having its external surface flush with the external surface of the leading end 184. The inset portion 186 of the liner has an inner surface of uniform diameter which corresponds to the external diameter of the outer sleeve 18 except along the convex surface portion 36'. The leading end 184 of the liner has sufficient give to expand slightly as it is axially advanced over the convex surface portion 36', as illustrated in FIG. 19, but will at least partially contract the convex surface portion into engagement with the braided layer B of the cable C. Under continued axial advancement, the inset portion 186 of the liner which is surrounded by the metal band 188 will have considerably less give or compressibility thereby forcing the convex surface portion 36' to be contracted to an external diameter corresponding to the rest of the sleeve 18 while urging the ribs 38 radially inwardly into more positive engagement with the braided layer B and jacket J of the cable C and terminating at its trailing end in an enlarged beveled end portion 190 which abuts the trailing edge of the liner 186.

In the fully closed position, as illustrated in FIG. 20, once again the crimping ring 180 will cause the convex surface portion 36' to contract into positive engagement with the braided layer B and jacket J toward the leading end of the cable C, and the rest of the sleeve 18 will be slightly compressed by the crimping ring 180 but not to the same extent as the form of connector shown in FIGS. 15 to 17.

Still another form of fitting is illustrated in FIGS. 21 to 25 wherein the fitting is made up of a modified form of F-connector 200 for connecting a standard coaxial cable C to a television terminal or on different components of a home entertainment system, not shown. The connector 200 is comprised of an elongated thin-walled inner sleeve 202 at an entrance end which is of uniform thickness and terminates in a ferrule 204 which is radially slotted at 205 as shown in FIGS. 22 to 25. The ferrule 204 terminates in abutting relation to a second ferrule 206 having an external groove 208 for a seal 209 and a shoulder 210 which bears against an end wall of a fastener 212. In accordance with well-known practice, the fastener 212 may either be threaded onto the terminal or press-fit or snap-fit into releasable engagement with the terminal. An outer thin-walled sleeve 214 is disposed in outer spaced concentric relation to the inner sleeve 202 with the inner sleeve extending slightly beyond the outer sleeve at their entrance end to form an annular space 216 with an annular partition wall 218 extending between the sleeves 202 and 214 at an intermediate location across the annular space so as to limit advancement of the outer braided layer B and the jacket J of the coaxial cable C. The outer sleeve 214 is thin-walled from the entrance end along its greater length and terminates in a convex surface portion 220 which overlies the ferrule 204, and the outer sleeve then terminates in an external groove 224 and shoulder 226, the latter bearing against the end of the fastener 212 and mounted in surrounding relation to the ferrule 206. The connector arrangement is further modified by having axially spaced sealing rings 226 around the inner surface of the outer sleeve 214 adjacent to the entrance end of the connector away from the bulge or convex surface portion 220 so as to be at the end opposite to the fastener end.

The cable C is a standard coaxial cable with its conductor pin P extending through the dielectric D and the exposed end of the pin P is inserted into the socket end of an extension tip X, the opposite end of the extension tip X being inserted into a socket or recessed end in a starter guide G. An insulation sleeve 207 is interposed between the ferrule 206 and the tip X and guide G. As best seen from FIG. 21, the starter guide G and extension tip X are pre-assembled within the connector body as shown in FIG. 21 or may be assembled onto the exposed end of the conductor pin P in guiding the cable into centered relation to the connector body, as shown in FIG. 22, until the leading end of the starter guide G extends beyond the fastener 212.

Figure 21:
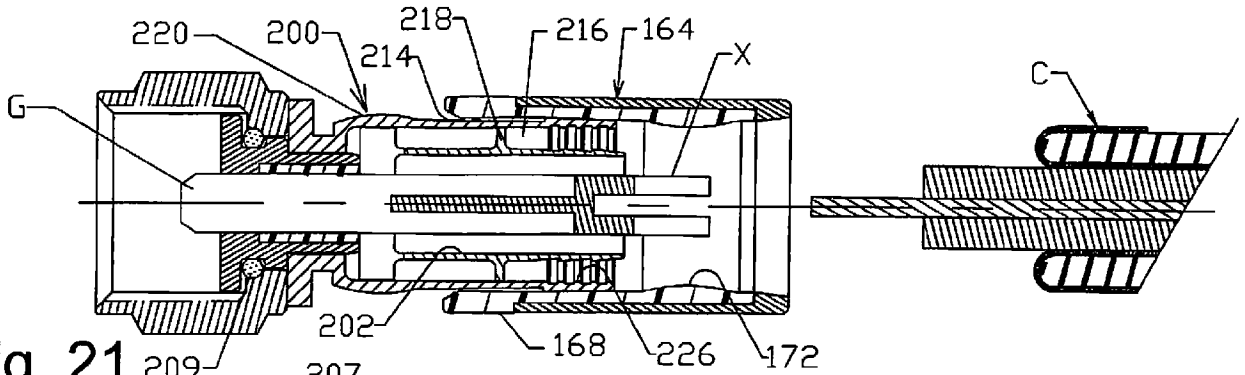
FIG. 21 is a longitudinal section view of still another embodiment having a connector body with a compression member pre-assembled thereon.
Figure 22:
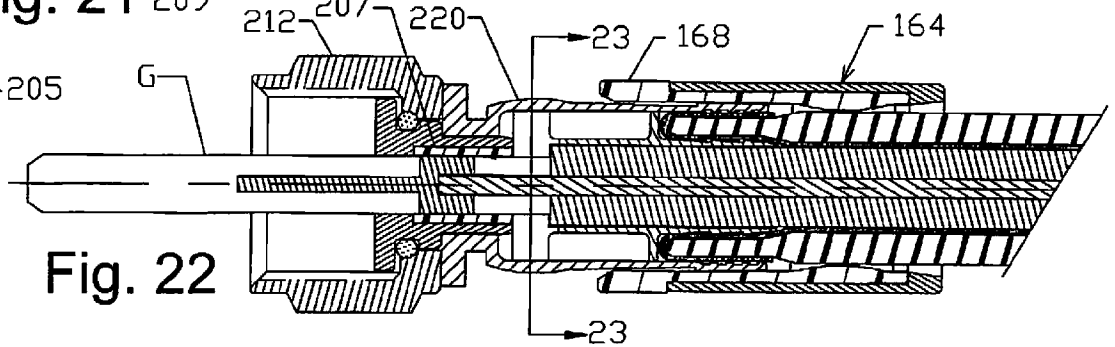
FIG. 22 is a longitudinal section view of the embodiment shown in FIG. 21 with the compression member in a partially closed position.
Figure 23:
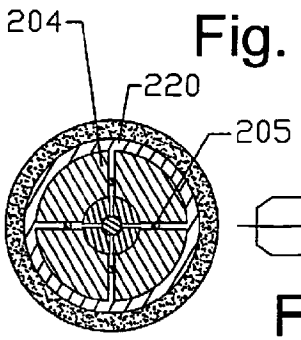
FIG. 23 is a cross-sectional view taken about lines 23-23 of FIG. 22.
Figure 24:
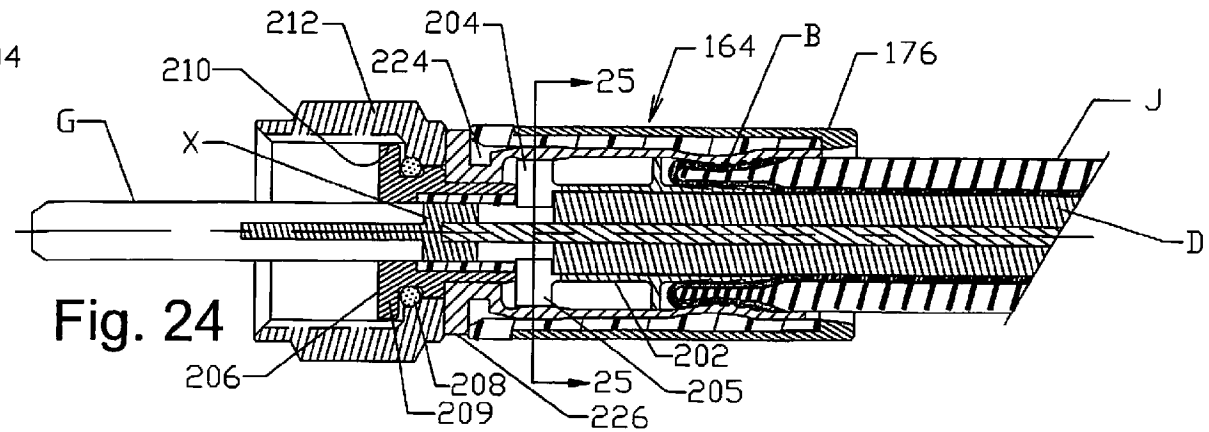
FIG. 24 is a longitudinal section view of the embodiment shown in FIG. 21 in the fully closed position.
Figure 25:
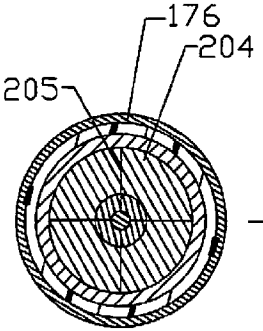
FIG. 25 is a cross-sectional view taken about lines 25-25 of the connector body shown in FIG. 21.

The crimping ring 164 in FIGS. 21 to 23 corresponds to the crimping ring 164 illustrated in FIGS. 15 to 17 and accordingly like parts are correspondingly enumerated. It should be noted that the crimping ring 164 is especially effective in contracting the sealing rings 226 into positive engagement with the braided layer and jacket and the convex surface portion 220 is compressed into positive engagement with the ferrule 204 at the end of the inner sleeve. Further, the leading end 218 is axially advanced over the convex surface portion 220 to deform it radially from the expanded position shown in FIGS. 22,23 to the contracted position shown in FIGS. 24,25. It should also be noted that the leading end 168 will advance beyond the convex surface portion 220 into abutting relation to the shoulder 226.

As a preliminary to the crimping operation, and with the crimping ring 44 being pre-assembled as earlier described, the cable C is advanced through the crimping ring 44 and the leading end or nose 132 of the extension tip 130 will initially engage the guide member 126 just prior to advancement of the outer braided layer B and jacket J into the space between the inner and outer sleeves 111 and 112. In the embodiments of FIGS. 12 to 19, the crimping operation is carried out in the same manner as described in reference to FIGS. 1 and 2 with a compression tool T illustrated in FIG. 11 and illustrated in more detail in U.S. Pat. No. 6,708,396 and incorporated by reference herein. Again, the jaws J1 and J2 are squeezed together to advance the compression member 164 over the convex bulge 220 whereby to radially deform or contract that portion of the sleeve 214 inwardly to cause the sealing ribs 226 to move into positive crimping engagement with the jacket J.

It will be appreciated from the foregoing that a greatly simplified form of termination assembly has been devised to effect localized sealed engagement of a connector body with an electrically conductive member, such as, a coaxial cable. One form of connector body having a bulge or convex surface portion on an external wall surface of its outer connector sleeve is adaptable for use in combination with a crimping ring having an inner wall-engaging surface of different configurations and yet achieve localized or broad sealed engagement between the connector sleeve and cable inserted into the sleeve. The convex surface 36 of the connector sleeve may assume slightly different configurations, such as, ramped, slight interruptions or undulations in its external surface, and the embodiments illustrated are examples only. In general, the degree of convexity of the external convex surface portions or bulges herein described will vary in accordance with the cable size. For example, a cable having a quad shield would require less thickness as well as length as emphasized in FIGS. 1 to 2. On the other hand, a universal-type connector which is designed for different cable sizes requires a thicker and longer convex surface portion 36, 36' with a greater number of sealing rings 38, 38' as exemplified in FIGS. 12 to 13. In addition, the depth and length of the convex surface portion 36, 36' may be readily adjusted for other reasons, such as, to increase or decrease the number and depth of the sealing rings or ribs 38, 38'.

In each form of invention, it is possible to exert the necessary pressure with a compression member having a selected inner diameter to compress the end portion of a sleeve on the connector portion of the assembly into sealed engagement with the outer surface of the cable in a rapid and highly efficient manner. The composition of the outer connector sleeve 18 preferably is a high strength metal material with sufficient malleability to undergo inward contraction along the convex surface portion or bulge from an outwardly convex to inwardly convex configuration. Nevertheless, it will be appreciated that numerous other materials with corresponding malleability can be employed. Moreover, it will be appreciated that while a preferred composition of the crimping rings is a combination of an inner plastic liner with an outer metal band that other materials with similar characteristics of the respective members can be employed.

Figure 26:
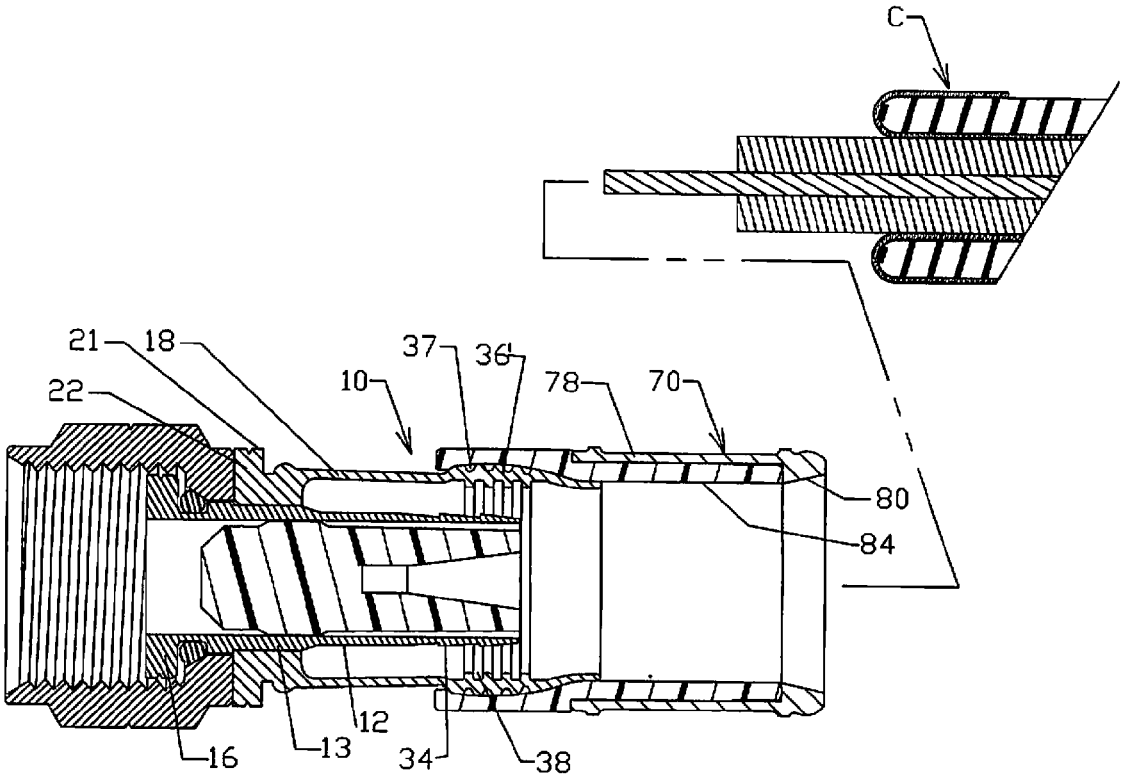
FIG. 26 is a longitudinal section view of one embodiment of a connector body with the cable in an unassembled position.
Figure 27:
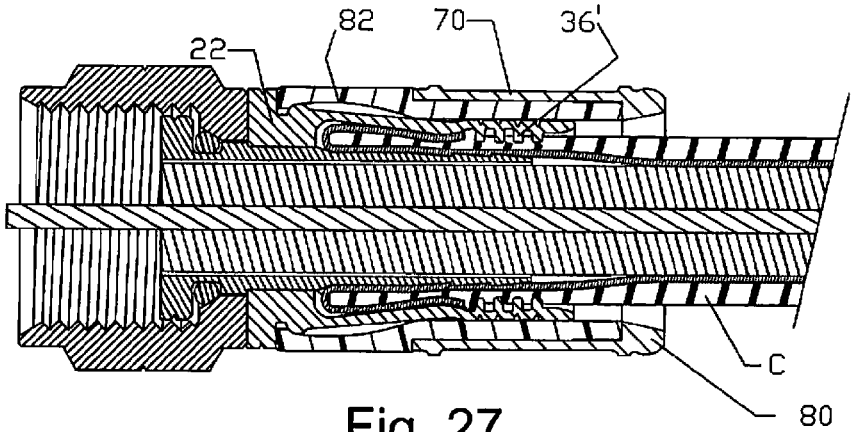
FIG. 27 is a longitudinal section view of the embodiment shown in FIG. 26 in a closed position.

In another embodiment shown in FIGS. 26 and 27, like parts to those of the embodiment shown in FIGS. 8 to 10 are correspondingly enumerated and new or modified parts are designated by prime numbers. The most significant departure resides in an external wall surface portion 36' of increased diameter with respect to the external diameter of the outer sleeve, and the portion 36' is provided with a series of axially spaced slots or grooves 37. As in FIGS. 8 to 10, the crimping ring 70 may be pre-assembled onto the connector 10 by advancing the surface portion 82 over the surface portion 36'; and continued advancement will cause the inner convex surface portion 84 to force the portion 36' to undergo radial contraction into positive engagement with the jacket on the cable C as shown in FIG. 27. The liner 74 includes a slight protuberance that will advance into the groove 21 of the connector body.

Figure 28:
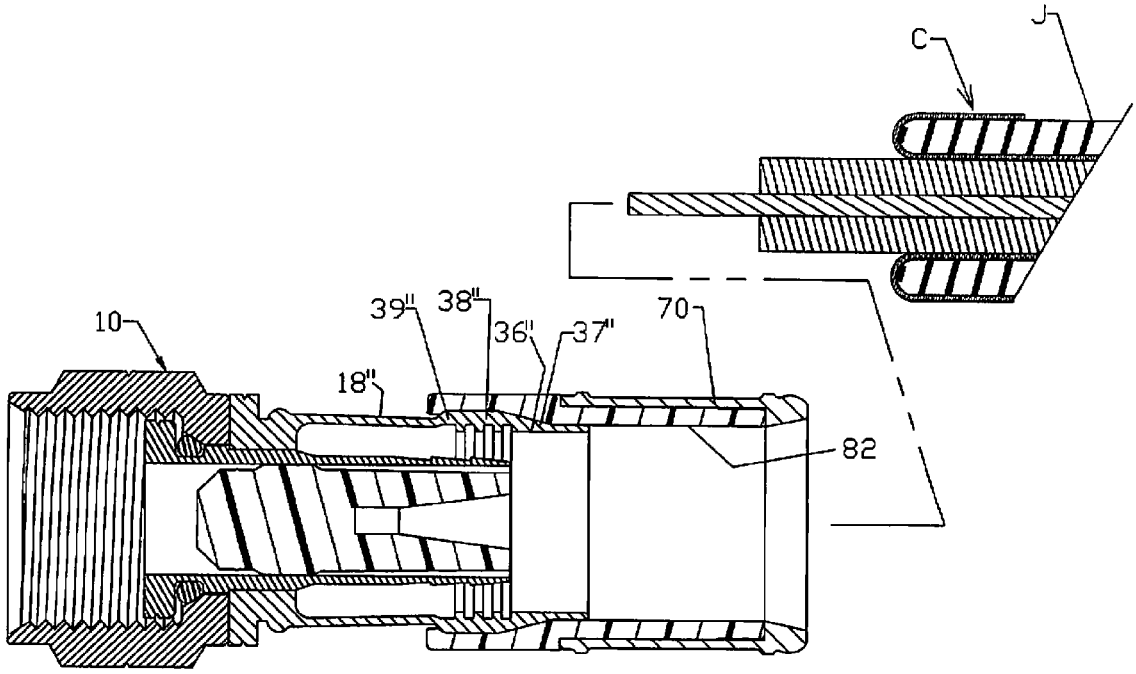
FIG. 28 is a longitudinal section view of another embodiment with the cable in an unassembled portion.
Figure 29:
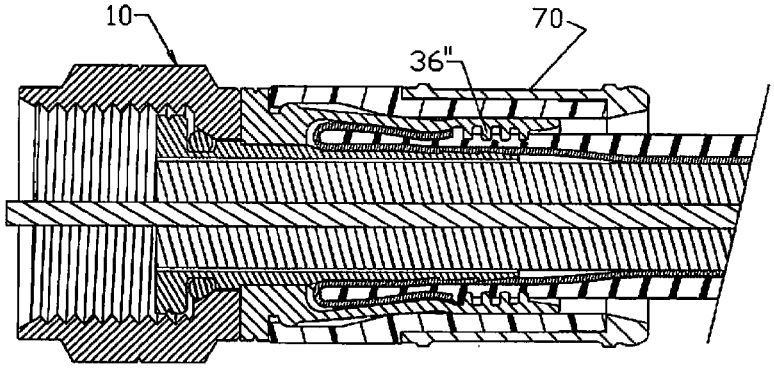
FIG. 29 is a section view in detail of the embodiment shown in FIG. 28 in a closed position.

FIGS. 28 and 29 illustrate another modified outer sleeve 18" having an external raised wall surface portion 36" inclines slopes outwardly away from the entrance end as at 37" into a flat outer surface 38" and then slopes or returns in a radially inward direction as at 39" back to the original diameter of the sleeve 18" so as to be of truncated convex configuration. As in FIGS. 26 and 27, advancement of the crimping ring surface portion 82 over the surface portion 36" will force the portion 36" to undergo radial contraction into positive engagement with the jacket J, and the protuberance 86 on the liner 74 will move into engagement with the groove 21 on the connector.

Figure 30:
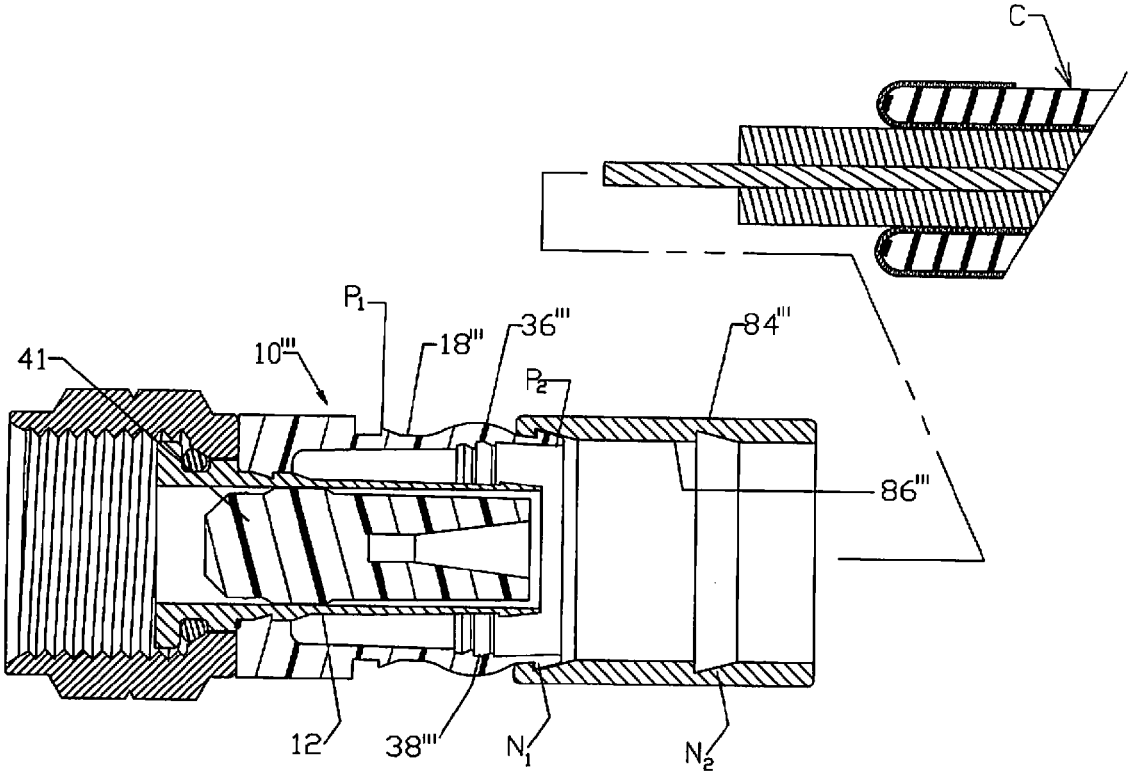
FIG. 30 is a longitudinal section view of a modified form of connector body with the cable in an unassembled position.
Figure 31:
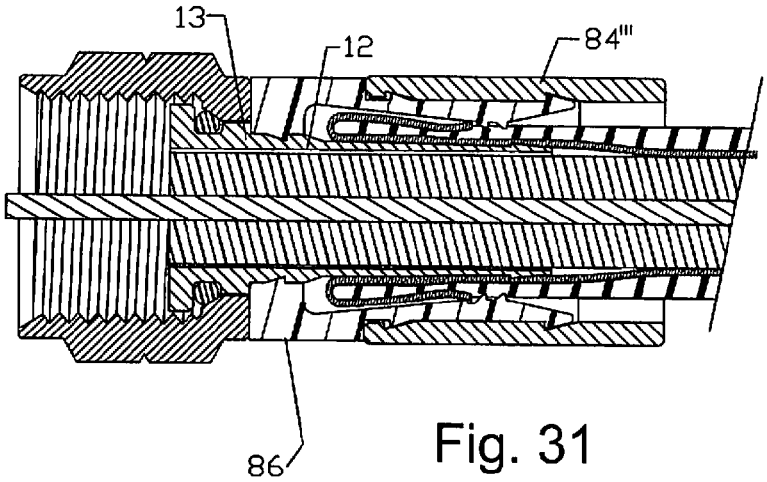
FIG. 31 is a section view of FIG. 29 in the closed position after assembly.

FIGS. 30-31 illustrate a modified form of coaxial cable termination assembly 10''' in which like parts to the previous embodiments are correspondingly enumerated and modified parts are designated by prime numbers. Thus the connector body 10''' is modified by substitution of an outer plastic connector sleeve 18''' for the metal sleeve 18 of, for example, FIGS. 8 to 10. The sleeve 18''' has a thin-walled portion extending from the entrance end with a convex surface portion 36 provided with inner sealing rings or grooves 38''', an enlarged shoulder 86 at the leading end is snap-fit into engagement with the ferrule end 13 of the inner sleeve 12. The outer sleeve 18''' is composed of a moldable plastic material, such as, DELRIN®, which is softer or more compressible than the outer metal sleeve material which is customarily used in the standard connectors of this type. In this way, the crimping ring 84''' may be comprised of a metal liner without an outer band having little or no give; and the inner liner itself has an inner diameter less than the outer convex surface portion 36''' so that when advanced over the outer sleeve 18'' will radially contract the sleeve into engagement with the cable C as best seen from FIG. 31. The crimping ring 84''' has an inner annular surface portion 86''' of substantially uniform diameter except for axially spaced, circumferentially extending notches N1 and N2 which will move into engagement with the protuberances P 1 and P 2 on the sleeve 18'''.

FIG. 30 illustrates the crimping ring 84''' in a pre-assembled position in which the notch N1 is snap-fit over the protuberance P2 at the entrance end of the sleeve 18'''. After the cable C is inserted into the starter guide 41 and then advanced into the assembled position as shown in FIG. 31, the crimping ring 84''' is advanced with a suitable compression tool, for example, of the type shown in FIG. 11 to the fully assembled or closed position as shown in FIG. 31 with the notches N1 and N2 inter-engaged with the protuberances P1 and P2, respectively.

Although the different forms of connector sleeves are illustrated for use in F-connectors as in FIGS. 1 to 31, it will be apparent that they are readily conformable for use with other types of connectors, such as, but not limited to BNC and RCA connectors. It is therefore to be understood that while selected forms of invention are herein set forth and described, the above and other modifications may be made therein without departing from the spirit and scope of the invention as defined by the appended claims and reasonable equivalents thereof.

I claim:

1. A cable termination assembly for connecting a cable having an electrically conductive member to another electrically conductive member comprising:

a connector body having a sleeve member of generally cylindrical configuration, an end of said cable extending concentrically within said sleeve member, and said sleeve member having a raised wall surface portion of enlarged rounded configuration with axially spaced grooves therein; and a cylindrical compression member having an inner annular surface portion slidable over said sleeve member, said inner annular surface portion engageable with said raised wall surface portion of said sleeve member wherein axial advancement of said compression member along said sleeve member will impart inward radial deformation to said sleeve member and force an internal wall surface portion of said sleeve member into a radially inwardly bowed configuration as it contracts into engagement with an external portion of said cable.

2. A cable termination assembly according to claim 1 wherein said inner annular surface portion of said compression member is of substantially uniform diameter.

3. A cable termination assembly according to claim 1 wherein said inner annular surface portion of said compression member is disposed along an intermediate portion of said sleeve.

4. A cable termination assembly according to claim 1 wherein said inner annular surface portion of said compression member includes a concave surface portion complementary to said external wall surface portion.

5. A cable termination assembly according to claim 4 wherein said compression member includes an inner convex surface portion in axially spaced relation to said concave surface portion.

6. A cable termination assembly according to claim 1 wherein said compression member includes releasable engagement means having a first engaging member projecting radially inwardly from said compression member and a second complementary engaging member projecting radially inwardly from an external wall surface of said sleeve member.

7. A cable termination assembly according to claim 1 wherein said compression member includes an inner concentric crimp ring.

8. A cable termination assembly according to claim 4 wherein said compression member has a plastic liner and an outer concentric metal band partially overlying said plastic liner and axially slidable with respect to said plastic liner.

9. A cable termination assembly according to claim 8 wherein said liner includes said concave and convex surface portions, and said band at least partially overlies said convex surface portion and includes an inner annular rib at an intermediate location.

10. A cable termination assembly according to claim 1 wherein said inner annular surface portion of said compression member includes an inner convex surface portion projecting radially inwardly therefrom whereupon axial advancement of said compression member along said sleeve member will cause said inner convex surface portion to impart inward radial deformation to said convex external surface into sealed engagement with an external surface portion of said cable.

11. A fitting for connecting a cable having an electrically conductive member to another electrically conductive member, said fitting comprising:

a thin-walled plastic sleeve member sized for axial insertion of an end of said cable through an entrance end thereof, said sleeve member provided with a raised surface portion at said entrance end of said sleeve member; and a cylindrical compression member having a first inner annular surface portion overlying said entrance end in pre-assembled relation to said sleeve member and a second annular surface portion of substantially uniform diameter in trailing relation to said first annular surface portion wherein axial advancement of said compression member along said sleeve member forces said first inner annular surface portion to move into engagement with said raised surface portion to impart inward radial deformation to said sleeve member into an inwardly bowed configuration and contracted into sealed engagement with said cable.

12. A fitting according to claim 11 wherein said compression member consists of a metal ring with inner annular surface portions of substantially uniform diameter.

13. A fitting according to claim 11 wherein said raised surface portion is of generally convex configuration extending away from said entrance end.

14. A fitting according to claim 13 including a first catch defined by a notch at a leading end of said compression member, and a second notch extending radially inwardly from a trailing end of said liner.

15. A fitting according to claim 11 provided with axially spaced annular notches on said inner annular surface portions.

16. fitting according to claim 15 wherein said notches are movable into engagement with axially spaced protuberances on said sleeve.

17. A fitting according to claim 11 wherein said sleeve member terminates in an enlarged shoulder.

18. In a cable termination assembly for connecting a coaxial cable to a terminal wherein said cable has an outer resilient jacket, inner and outer spaced concentric electrically conductive portions and wherein a connector body has a fastener for connection to said terminal and inner and outer concentric sleeve members having an entrance end with axially spaced sealing ribs on an inner surface of said outer sleeve member adjacent to said fastener and away from said entrance end for insertion of said inner electrically conductive portion within said inner sleeve member and insertion of said outer concentric electrically conductive portion between said inner sleeve member and said outer sleeve member, the improvement comprising:

said outer sleeve composed of a compressible plastic material having an enlarged shoulder portion at one end and a generally convex external wall surface portion at an opposite entrance end substantially coextensive with said sealing ribs; and a crimping ring consisting of a metal ring member having an inner surface portion of substantially uniform diameter wherein slidable axial advancement of said crimping ring with respect to said outer sleeve member will impart inward radial deformation to said external convex wall surface portion to force said sealing ribs into inwardly bowed configuration as said ribs are contracted into sealed engagement with an external surface of said cable.

19. A cable termination assembly according to claim 18 wherein said external shoulder on said outer sleeve is mounted in press fit relation to an end of said inner sleeve opposite to said entrance end.

20. A cable termination assembly for connecting a cable having an electrically conductive member to another electrically conductive member comprising:

a connector body having a sleeve member of generally cylindrical configuration, an end of said cable extending concentrically within said sleeve member, and said sleeve member having a raised wall surface portion of generally truncated convex configuration adjacent to an entrance end thereof; and a cylindrical compression member having an inner annular surface portion slidable over said sleeve member, said inner annular surface portion engageable with said raised wall surface portion of said sleeve member wherein axial advancement of said compression member along said sleeve member will impart inward radial deformation to said sleeve member and force an internal wall surface portion of said sleeve member into a radially inwardly bowed configuration as it contracts into engagement with an external portion of said cable.

* * * * *